US012134026B2

(12) United States Patent
Bovino

(10) Patent No.: US 12,134,026 B2
(45) Date of Patent: Nov. 5, 2024

(54) SYSTEMS AND METHODS FOR MASKING PINSETTERS OF BOWLING LANES

(71) Applicant: DFX: Sound Vision, West Berlin, NJ (US)

(72) Inventor: Michael Bovino, Cherry Hill, NJ (US)

(73) Assignee: DFX: SOUND VISION, West Berlin, NJ (US)

( * ) Notice: Subject to any disclaimer, the term of this patent is extended or adjusted under 35 U.S.C. 154(b) by 0 days.

(21) Appl. No.: 17/758,255

(22) PCT Filed: Dec. 29, 2020

(86) PCT No.: PCT/US2020/067238

§ 371 (c)(1),
(2) Date: Jun. 30, 2022

(87) PCT Pub. No.: WO2021/138281

PCT Pub. Date: Jul. 8, 2021

(65) Prior Publication Data

US 2023/0021367 A1 Jan. 26, 2023

Related U.S. Application Data

(60) Provisional application No. 62/954,891, filed on Dec. 30, 2019.

(51) Int. Cl.
*A63D 5/04* (2006.01)
*A63D 5/08* (2006.01)

(52) U.S. Cl.
CPC ..... *A63D 5/04* (2013.01); *A63D 5/08* (2013.01)

(58) Field of Classification Search
CPC ..... A63D 5/04; A63D 5/08
See application file for complete search history.

(56) References Cited

U.S. PATENT DOCUMENTS 2,485,347 A * 10/1949 Robert ..... A63D 5/00 473/64
5,356,346 A 10/1994 Katje et al.
(Continued)

FOREIGN PATENT DOCUMENTS

JP H10151236 A * 9/1998
WO WO-2012057734 A1 * 5/2012 ..... F16M 13/02

OTHER PUBLICATIONS

Combat Ops, Mini Bowling, video wall, https://combatops.com/our-attractions/mini-bowling, https://web.archive.org/web/20211022212840/https://combatops.com/our-attractions/mini-bowling, Oct. 2021.*

*Primary Examiner* — William M Pierce
(74) *Attorney, Agent, or Firm* — FOX ROTHSCHILD LLP

(57) ABSTRACT

Systems and methods for masking pinsetters of a bowling center. The systems comprise a modular masking unit that comprises a first array of displays structurally supported by a support frame. The support frame is mounted to the ground so that the array of displays extends over a pair of bowling lanes and masks the p insetters for the pair of bowling lanes. The displays are arranged such that they can be independently controlled to provide a plurality of small displays or collectively controlled to provide a single large multi-panel display. The support frame is height adjustable such that a distance between the array of displays and the ground is adjustable (e.g., so that the masking unit can fit in between or in conjunction with all types of pinsetters, bowling scoring systems, and/or other masking units).

23 Claims, 9 Drawing Sheets

(56) References Cited

U.S. PATENT DOCUMENTS

| | | | | |
|---|---|---|---|---|
| 5,779,554 | A * | 7/1998 | Sanders | A63D 5/00 473/54 |
| 5,888,143 | A * | 3/1999 | McKinney | A63D 5/00 473/54 |
| 6,101,750 | A * | 8/2000 | Blesener | G09F 13/04 40/448 |
| 6,270,421 | B1 | 8/2001 | Tsujita | |
| 8,606,949 | B2 * | 12/2013 | Wogsberg | H04N 21/2343 709/230 |
| 8,988,314 | B2 * | 3/2015 | Akitomo | G06F 3/1446 345/1.3 |
| 9,311,833 | B2 * | 4/2016 | George, II | G09F 15/0037 |
| 9,803,795 | B2 * | 10/2017 | Brandt | G06F 1/1601 |
| 2008/0182676 | A1 | 7/2008 | Recknagel et al. | |
| 2013/0324272 | A1 * | 12/2013 | Vaioli | A63D 5/04 473/54 |
| 2015/0297976 | A1 | 10/2015 | Bovino | |
| 2015/0301509 | A1 * | 10/2015 | Bovino | A63D 5/04 700/90 |
| 2019/0332000 | A1 * | 10/2019 | DeMeo | F16M 11/38 |
| 2020/0015588 | A1 * | 1/2020 | Patrick | F16M 11/32 |
| 2020/0347986 | A1 * | 11/2020 | Xiang | A47B 83/001 |

* cited by examiner

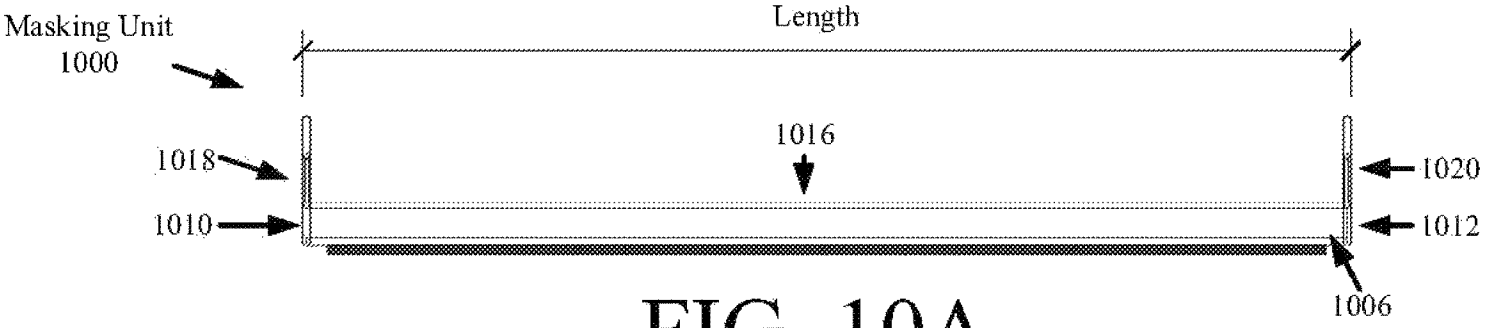
FIG. 10A
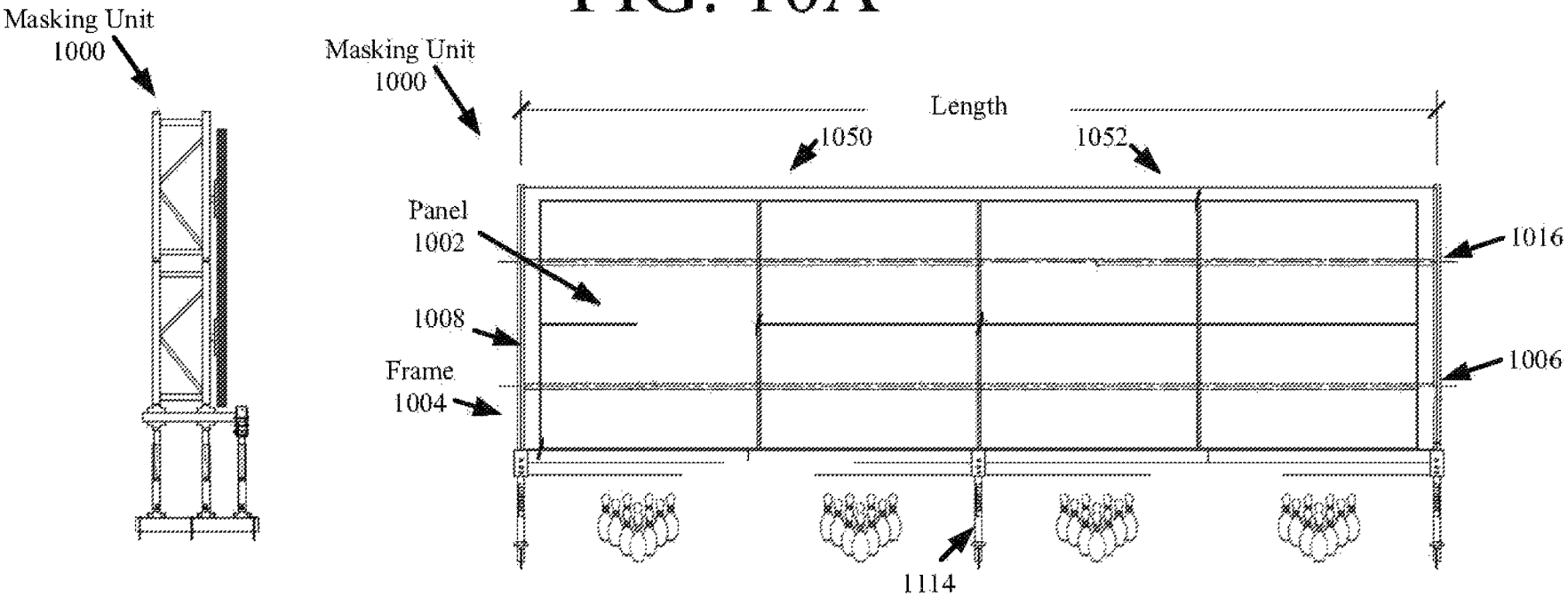
FIG. 10C
FIG. 10B

SYSTEMS AND METHODS FOR MASKING PINSETTERS OF BOWLING LANES

CROSS-REFERENCE TO RELATED APPLICATION

This application claims priority to U.S. Provisional Patent Application No. 62/954,891, filed Dec. 30, 2019, the entire contents of which is incorporated by reference in its entirelty.

BACKGROUND

Statement of the Technical Field

The present disclosure relates generally to bowling center systems. More particularly, the present disclosure relates to implementing systems and methods for masking pinsetters of bowling lanes.

Description of the Related Art

A bowling alley comprises a long narrow wooden lane along which a bowling ball is rolled towards a set of ten pins, i.e., from a front end to a back end. One or more of the pins is knocked down or otherwise displaced by the ball. A mechanical pinsetter is located at the distal end of the lane. The mechanical pinsetter resets the pins to their correct positions after being knocked down or displaced by the bowling ball, and sends the bowling ball back to the front end of the lane. The mechanical pinsetter is often integrated with an electronic scoring system.

SUMMARY

The present disclosure concerns implementing systems and methods for masking pinsetters of a bowling center. The systems comprise at least one masking unit. The masking unit comprises a first array of displays (e.g., Light Emitting Diode ("LED") panels, Liquid Crystal Display ("LCD") panels, and/or Plasma Display Panel ("PDP")) structurally supported by a first support frame. The support frame is mounted to the ground (e.g., a bowling lane support structure) so that the first array of displays extends over a first pair of bowling lanes and masks the pinsetters for the first pair of bowling lanes. The displays are arranged such that they can be independently controlled to provide a plurality of small displays or collectively controlled to provide a single large multi-panel display. The support frame is height adjustable such that a distance between the first array of displays and the ground is adjustable (e.g., so that the masking unit can fit in between or in conjunction with all types of pinsetters, bowling scoring systems, and/or other masking units).

The support frame comprises: a right side vertical support member configured to facilitate vertical support of the array of displays; a left side vertical support member configured to facilitate vertical support of the array of displays; at least one elongate bar extending between the right side vertical support member and the left side vertical support member; at least one strut bar coupled between the elongate bar and the array of displays; a right side vertical mounting leg coupled to the right side vertical support member and the ground, and configured to facilitate a height adjustment of the right side vertical support member; a left side vertical mounting leg coupled to the left side vertical support member and the ground, and configured to facilitate a height adjustment of the left side vertical support member; and/or a horizontal support member that extends between the right side vertical mounting leg and the left side vertical mounting leg, facilitates horizontal support of the first or second array of displays, and is mechanically coupled to a bottom row of displays of the first or second array.

In some scenarios, each of the right side vertical support member and the left side vertical support member comprises a ladder truss structure. In other scenarios, each of the right side vertical support member and the left side vertical support member comprises at least two ladder truss structure sub-pieces that are joined together to form a large ladder truss structure.

The present disclosure also concerns a modular system for masking pinsetters of a bowling center. The modular system comprises a first modular masking unit and a second modular masking unit connected to the first modular masking unit. The first modular masking unit and the second modular masking unit can have the same or similar architecture as the modular masking unit described above.

The first modular masking unit comprises a first array of displays (e.g., LED panels) that are structurally supported by a first support frame mounted to the ground (e.g., a bowling lane support structure). The first array of displays masks pinsetters for a first pair of bowling lanes. The second modular masking unit comprises a second array of displays (e.g., LED panels) that are structurally supported by a second support frame mounted to the ground. The second array of displays masks pinsetters for a second pair of bowling lanes adjacent to the first pair of bowling lanes. The first and second modular masking units are configured for selective use as two media display systems independent of each other at a first time and for selective use collectively as a single media display system at a second different time. The first support frame and the second support frame are height adjustable.

The first and second modular masking units are at least one of mechanically connectable to each other and electrically connectable to each other. Accordingly, a seamless display wall is provided when the first modular masking unit and the second modular masking unit are coupled to each other. The displays of the first or second array are arranged such that they can be independently controlled to provide a plurality of small displays or collectively controlled to provide a single large multi-panel display.

BRIEF DESCRIPTION OF THE DRAWINGS

The present solution will be described with reference to the following drawing figures, in which like numerals represent like items throughout the figures.

FIGS. 10A, 10B, and 10C (collectively referred to herein as "FIG. 10") provide illustrations of another illustrative masking unit.

DETAILED DESCRIPTION

Figure 1:
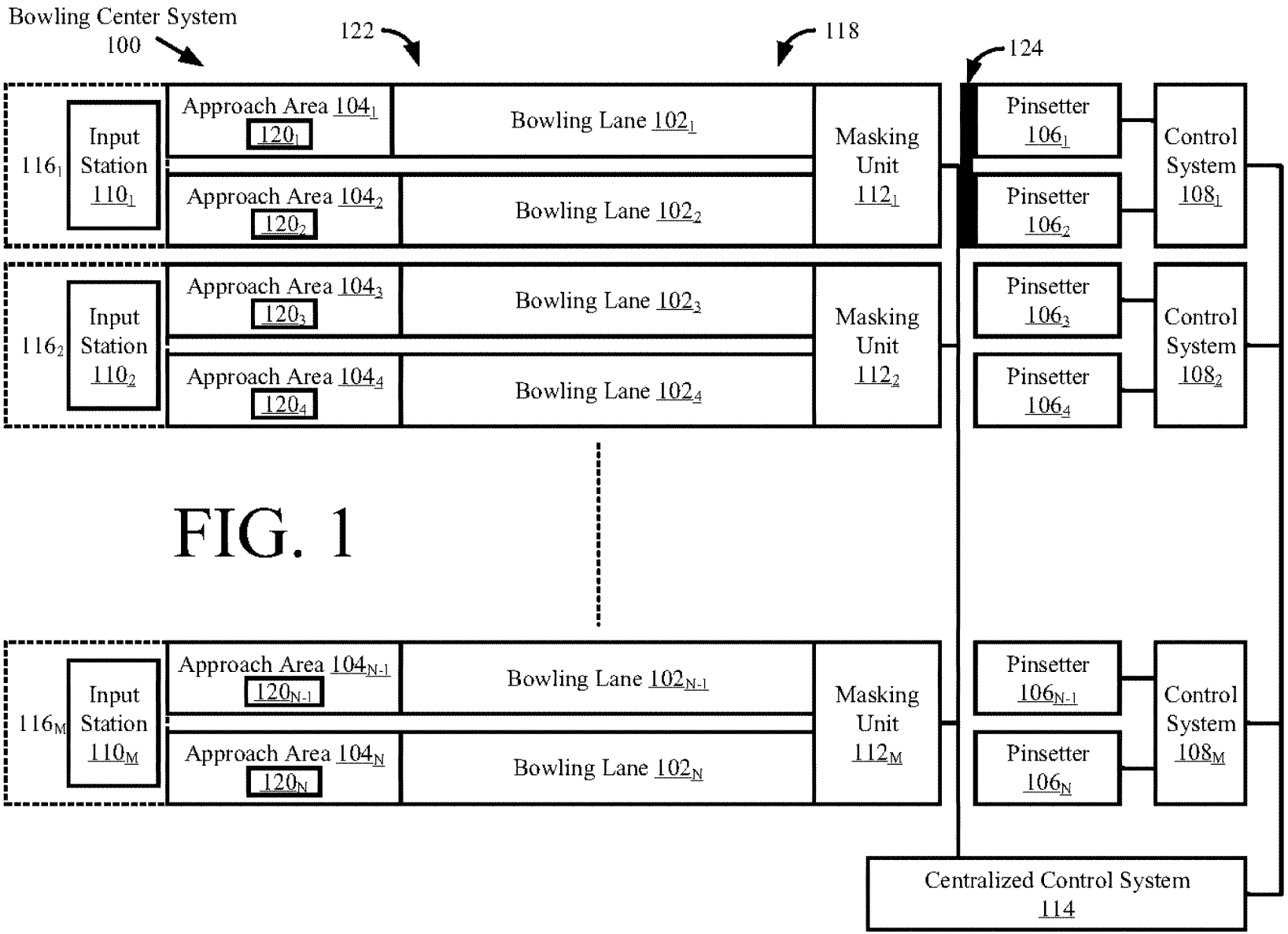
FIG. 1 is an illustration of an illustrative architecture for a bowling center system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present solution generally concerns systems and methods for masking pinsetters of a bowling center. The systems comprise at least one masking unit. The masking unit comprises a first array of displays (e.g., LED panels, LCD panels, and/or PDP based displays) structurally supported by a first support frame. The support frame is mounted to the ground (e.g., a bowling lane support structure) so that the first array of displays extends over a first pair of bowling lanes and masks the pinsetters for the first pair of bowling lanes. The displays are arranged such that they can be independently controlled to provide a plurality of small displays or collectively controlled to provide a single large multi-panel display. The support frame is height adjustable such that a distance between the first array of displays and the ground is adjustable.

The support frame comprises: a right side vertical support member configured to facilitate vertical support of the array of displays; a left side vertical support member configured to facilitate vertical support of the array of displays; at least one elongate bar extending between the right side vertical support member and the left side vertical support member; at least one strut bar coupled between the elongate bar and the array of displays; a right side vertical mounting leg coupled to the right side vertical support member and the ground, and configured to facilitate a height adjustment of the right side vertical support member; a left side vertical mounting leg coupled to the left side vertical support member and the ground, and configured to facilitate a height adjustment of the left side vertical support member; and/or a horizontal support member that extends between the right side vertical mounting leg and the left side vertical mounting leg, facilitates horizontal support of the first or second array of displays, and is mechanically coupled to a bottom row of displays of the first or second array.

In some scenarios, each of the right side vertical support member and the left side vertical support member comprises a ladder truss structure. In other scenarios, each of the right side vertical support member and the left side vertical support member comprises at least two ladder truss structure sub-pieces that are joined together to form a large ladder truss structure.

The present disclosure also concerns a modular system for masking pinsetters of a bowling center. The modular system comprises a first modular masking unit and a second modular masking unit connected to the first modular masking unit. The first modular masking unit and the second modular masking unit can have the same or similar architecture as the modular masking unit described above.

The first modular masking unit comprises a first array of displays (e.g., LED panels, LCD panels, and/or PDP based displays) that are structurally supported by a first support frame mounted to the ground (e.g., a bowling lane support structure). The first array of displays masks pinsetters for a first pair of bowling lanes. The second modular masking unit comprises a second array of displays (e.g., LED panels, LCD panels, and/or PDP based displays) that are structurally supported by a second support frame mounted to the ground. The second array of displays masks pinsetters for a second pair of bowling lanes adjacent to the first pair of bowling lanes. The first and second modular masking units are configured for selective use as two media display systems independent of each other at a first time and for selective use collectively as a single media display system at a second different time. The first support frame and the second support frame are height adjustable.

The first and second modular masking units are at least one of mechanically connectable to each other and electrically connectable to each other. Accordingly, a seamless display wall is provided when the first modular masking unit and the second modular masking unit are coupled to each other. The displays of the first or second array are arranged such that they can be independently controlled to provide a plurality of small displays or collectively controlled to provide a single large multi-panel display.

In some scenarios, one or more ball indicator lights are coupled to the support frame(s) and/or integrated with the display(s). The ball indicator lights are provided to indicate to a bowler which bowling shot (s)he is on. For example, the total number of eliminated ball indicator lights represents the current bowling shot number (e.g., ball one, ball two, etc.). The ball indicator lights are communicatively coupled to and/or controlled by a bowling scoring system.

Referring now to FIG. 1, there is provided an illustration of an illustrative architecture for a bowling center system 100. The bowling center system 100 can include more or less components than that shown in FIG. 1. The bowling center system 100 is generally configured to allow people to play bowling games.

The bowling center system 100 comprises a plurality of bowling lanes $\mathbf{102}_1$, $\mathbf{102}_2$, $\mathbf{102}_3$, $\mathbf{102}_4$, . . . , $\mathbf{102}_{N-1}$, $\mathbf{102}_N$ (collectively referred to as "bowling lanes 102"). Each bowling lane has an approach area $\mathbf{104}_1$, $\mathbf{104}_2$, $\mathbf{104}_3$, $\mathbf{104}_4$, . . . , $\mathbf{104}_{N-1}$, $\mathbf{104}_N$ (collectively referred to as "approach areas 104") associated therewith. The approach area is located at a front end 122 of the bowling lane. The bowling lanes 102 are grouped into lane pairs. Lanes $\mathbf{102}_1$ and $\mathbf{102}_2$ comprise a first lane pair. Lanes $\mathbf{102}_3$ and $\mathbf{102}_4$ comprise a second lane pair. Lanes $\mathbf{102}_{N-1}$ and $\mathbf{102}_N$ comprise a third lane pair. Any number of bowling lane pairs can be provided in accordance with a given application.

A pinsetter $\mathbf{106}_1$, $\mathbf{106}_2$, $\mathbf{106}_3$, $\mathbf{106}_4$, . . . , $\mathbf{106}_{N-1}$, $\mathbf{106}_N$ (collectively referred to as "pinsetters 106") is provided for each bowling lane $\mathbf{102}_1$, $\mathbf{102}_2$, $\mathbf{102}_3$, $\mathbf{102}_4$, . . . , $\mathbf{102}_{N-1}$, $\mathbf{102}_N$. The two pinsetters for each lane pair are coupled to a respective control system $\mathbf{108}_1$, $\mathbf{108}_2$, . . . , $\mathbf{108}_M$ (collectively referred to as "control systems 108"). The control system $\mathbf{108}_1$, $\mathbf{108}_2$, . . . , $\mathbf{108}_M$ operates both pinsetters of the respective lane pair to set a desired array of pins to the bowling game being played. The control system $\mathbf{108}_1$, $\mathbf{108}_2$, . . . , $\mathbf{106}_M$ also facilitates automatic scoring for the bowling game.

A masking unit $\mathbf{112}_1$, $\mathbf{112}_2$, . . . , $\mathbf{112}_M$ (collectively referred to as "masking units 112") is provided to mask or conceal the two pinsetters 106 for a respective pair of bowling lanes. The masking unit can also mask or conceal existing making units 124 which may or may not comprise display screens. Accordingly, the masking unit is disposed at back ends 118 of the bowling lanes of the respective pair. The masking unit comprises an array of displays (not visible in FIG. 1). The displays include, but are not limited to, Light Emitting Diode ("LED") display panels, Liquid Crystal Display ("LCD") panels, and/or Plasma Display Panels ("PDPs"). LED display panels, LCD panels, and PDPs are well known in the art, and therefore will not be described herein. Any known or to be known LED display panels, LCD panels, and PDPs can be used herein without limitation. The array of displays are arranged such that they can be independently controlled to provide a plurality of smaller video screens or collectively controlled to provide a single larger video screen. Control of the masking units 112 is provided by control systems 108 and/or a centralized control system 114.

The masking units 112 are modular components. Each modular component (i.e., each masking unit) can be replaced, removed or used on its own. The masking units can also be used together as an integrated system for media content display. The masking units can be replaced at different times during use of the bowling center system 100 without impacting operation of the remaining masking units or other components of the bowling center system 100. For example, a first modular masking unit $\mathbf{112}_1$ is connectable to a second modular masking unit $\mathbf{112}_1$ such that a mechanical connection and/or an electrical connection is established therebetween. The first and second modular masking units $\mathbf{112}_1$, $\mathbf{112}_2$ are configured for replacement independent of the other component. A third modular masking unit (not shown in FIG. 1) is connectable to the second modular masking unit $\mathbf{112}_2$ such that a mechanical connection and/or an electrical connection is established therebetween. The first modular masking unit $\mathbf{112}_1$ includes at least one electrical connection port for communicatively coupling to the second modular masking unit $\mathbf{112}_2$. The second modular masking unit $\mathbf{112}_2$ includes electrical connection ports for communicatively coupling to both the first and third modular masking units. The third modular masking unit includes at least one electrical connection port for communicatively coupling to the second modular masking unit $\mathbf{112}_2$. The present solution is not limited to the particulars of this example.

An input station $\mathbf{110}_1$, $\mathbf{110}_2$, . . . , $\mathbf{110}_M$ (collectively referred to as "input stations 110") is also provided for each lane pair in a respective staging area $\mathbf{116}_1$, $\mathbf{116}_2$, . . . , $\mathbf{116}m$ (collectively referred to as "staging areas 116"). Bowlers wait in the staging area $\mathbf{116}_1$, $\mathbf{116}_2$, . . . , $\mathbf{116}_M$ until it is their turn to play the bowling game. The input station allows the bowlers to enter information into the bowling center system 100. The entered information is communicated from the input station to the respective control system $\mathbf{108}_1$, $\mathbf{108}_2$, . . . , $\mathbf{106}_M$. Accordingly, the input stations are connected to the control systems, respectively. Such connections are not shown in FIG. 1 for simplicity of illustration. Connecting the displays to the bowling scoring system allows these displays to show the score associated with each bowler. This makes it possible to remove the dedicated bowling scoring monitors above the bowler seating area.

An overhead display $\mathbf{120}_1$, $\mathbf{120}_2$, $\mathbf{120}_3$, $\mathbf{120}_4$, . . . , $\mathbf{120}_{N-1}$, $\mathbf{120}_N$ (collectively referred to as "overhead displays 120") is provided in the approach area $\mathbf{104}_1$, $\mathbf{104}_2$, $\mathbf{104}_3$, $\mathbf{104}_4$, . . . , $\mathbf{104}_{N-1}$, $\mathbf{104}_N$ of each bowling lane $\mathbf{102}_1$, $\mathbf{102}_2$, $\mathbf{102}_3$, $\mathbf{102}_4$, . . . , $\mathbf{102}_{N-1}$, $\mathbf{102}_N$. Scores and other information is displayed on the overhead display.

A centralized control system 114 is communicatively coupled to the control systems 108. The centralized control system 114 provides accounting control of the bowling lanes 102 as well as the ability to download game information to the control systems 108. The control system also controls the media content (e.g., audio and video) provided to and output by the overhead displays 120 and/or the masking units 112.

Figure 2:
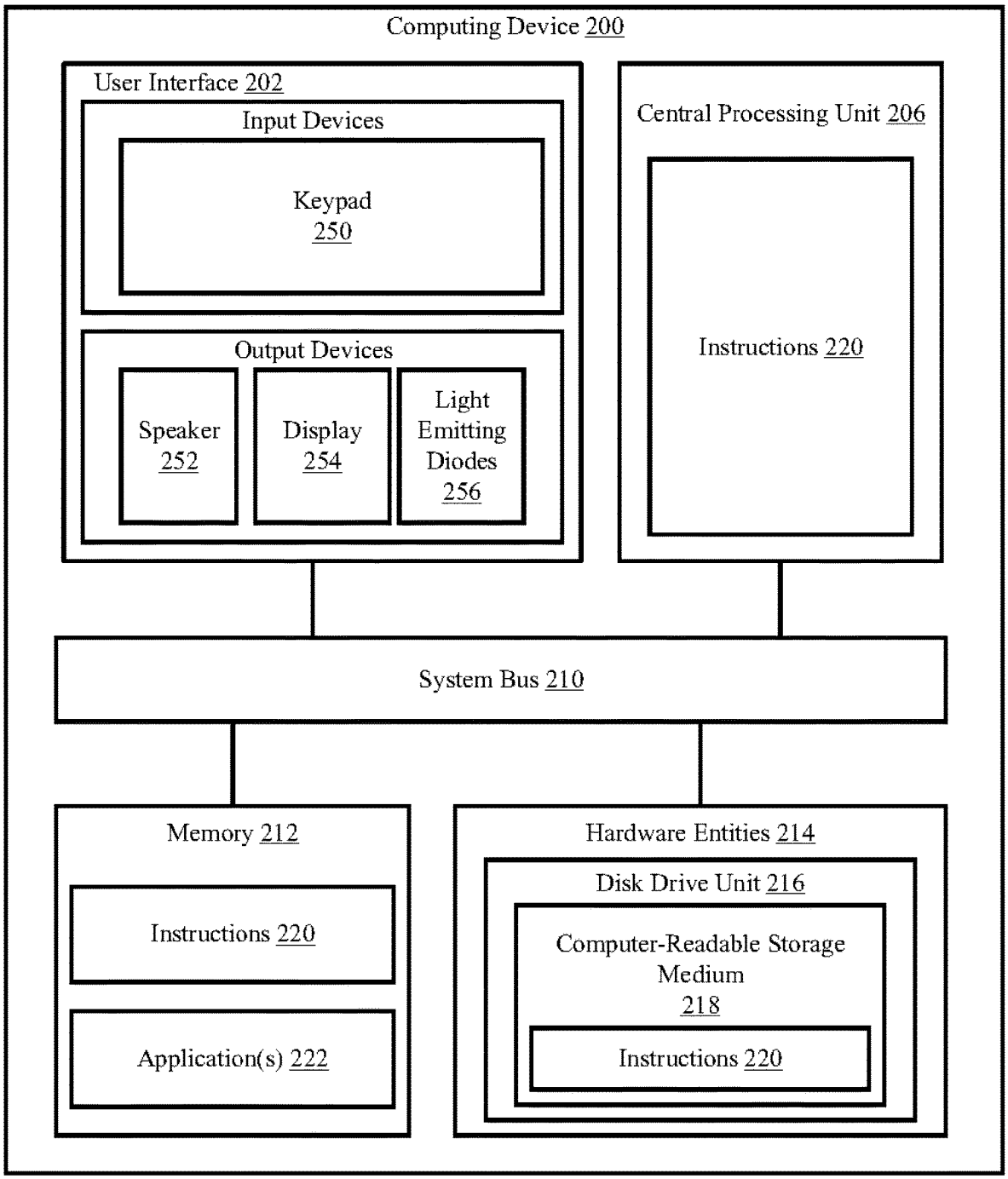
FIG. 2 is an illustration of an illustrative architecture for a computing device.

Referring now to FIG. 2, there is provided a detailed block diagram of an illustrative architecture for a computing device 200. The control systems 108 and/or the centralized control system 114 of FIG. 1 is/are the same as or substantially similar to computing device 200. As such, the following discussion of computing device 200 is sufficient for understanding computing systems 108, 114.

Notably, the computing device 200 may include more or less components than those shown in FIG. 2. However, the components shown are sufficient to disclose an illustrative embodiment implementing the present solution. The hardware architecture of FIG. 2 represents one embodiment of a representative computing device configured to facilitate a bowling process. As such, the computing device 200 of FIG. 2 implements at least a portion of the methods described herein.

Some or all the components of the computing device 200 can be implemented as hardware, software and/or a combination of hardware and software. The hardware includes, but is not limited to, one or more electronic circuits. The electronic circuits can include, but are not limited to, passive components (e.g., resistors and capacitors) and/or active components (e.g., amplifiers and/or microprocessors). The passive and/or active components can be adapted to, arranged to and/or programmed to perform one or more of the methodologies, procedures, or functions described herein.

As shown in FIG. 2, the computing device 200 comprises a user interface 202, a Central Processing Unit ("CPU") 206, a system bus 210, a memory 212 connected to and accessible by other portions of computing device 200 through system bus 210, and hardware entities 214 connected to system bus 210. The user interface can include input devices (e.g., a keypad 250) and output devices (e.g., speaker 252, a display 254, and/or light emitting diodes 256), which facilitate user-software interactions for controlling operations of the computing device 200.

At least some of the hardware entities 214 perform actions involving access to and use of memory 212, which can be a RAM, a disk driver and/or a Compact Disc Read Only Memory ("CD-ROM"). Hardware entities 214 can include a disk drive unit 216 comprising a computer-readable storage medium 218 on which is stored one or more sets of instructions 220 (e.g., software code) configured to implement one or more of the methodologies, procedures, or functions described herein. The instructions 220 can also reside, completely or at least partially, within the memory 212 and/or within the CPU 206 during execution thereof by the computing device 200. The memory 212 and the CPU 206 also can constitute machine-readable media. The term "machine-readable media", as used here, refers to a single medium or multiple media (e.g., a centralized or distributed database, and/or associated caches and servers) that store the one or more sets of instructions 220. The term "machine-readable media", as used here, also refers to any medium that is capable of storing, encoding or carrying a set of instructions 220 for execution by the computing device 200 and that cause the computing device 200 to perform any one or more of the methodologies of the present disclosure.

In some scenarios, the hardware entities 214 include an electronic circuit (e.g., a processor) programmed for facilitating a bowling process. In this regard, it should be understood that the electronic circuit can access and run application(s) 222 installed on the computing device 200. The software application(s) 222 is(are) generally operative to facilitate accounting control of the bowling lanes, downloading of game information to control systems, control of media content (e.g., audio and video) provided to and displayed by overhead displays and/or masking units. Other functions of the software application(s) 222 will become apparent as the discussion progresses.

Figure 3:
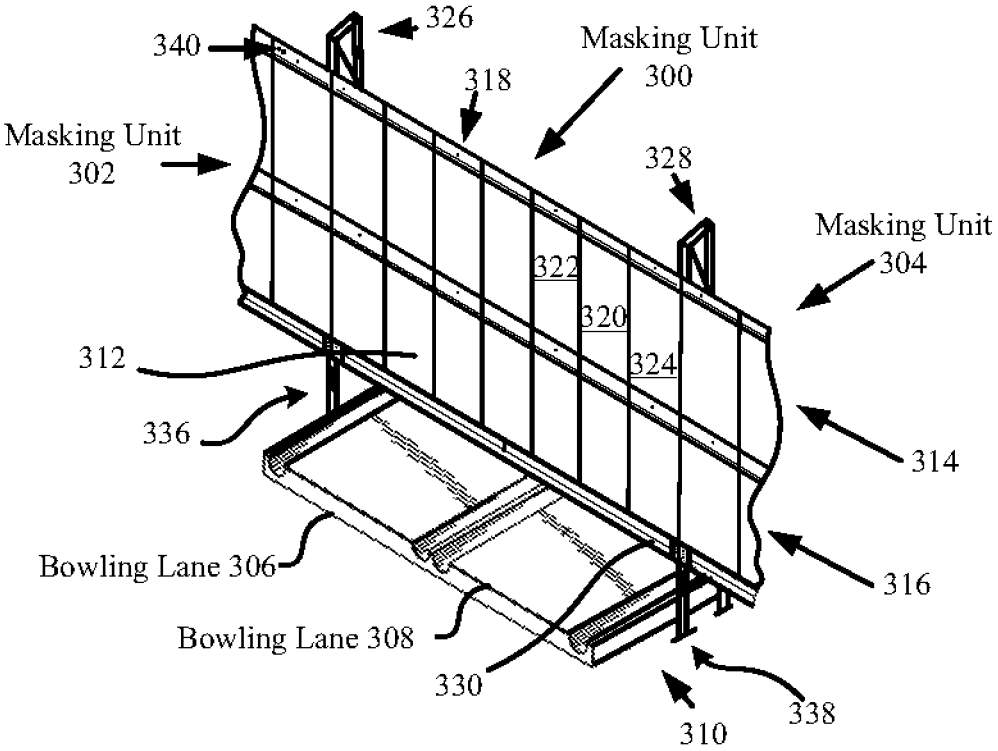
FIG. 3 is a perspective view of an illustrative architecture for a masking unit shown in FIG. 1 masking pinsetters of a lane pair.

Referring now to FIGS. 3-9, there are provided illustrations that are useful for understanding an illustrative architecture for a masking unit 300. The masking units 112 of FIG. 1 are the same as or similar to the masking unit 300. As shown in FIG. 3, the masking unit 300 is a modular component connected to another masking unit 302, 304 on both sides. The present solution is not limited in this regard. The masking unit 300 can be connected to just one of the other masking units 302, 304 or coupled to neither of the masking units 302, 304. The connection between two adjacent masking units comprises a mechanical connection and/or an electrical connection. The manner in which these connections are made will become more evident as the discussion progresses. Notably, a seamless display wall can be provided when two or more masking units are connected to each other.

The masking unit 300 is designed to mask pinsetters 400 for a pair of bowling lanes 306, 308 and/or other objects (e.g., conventional masking units). Thus, the modularity of the masking units 300, 302, 304 is a multiple of two lanes. For example, if pinsetters for four lanes are to be concealed, then two masking units are employed. In contrast, if pinsetters for six lanes are to be concealed, then three masking units are employed, and so on.

Figure 4:
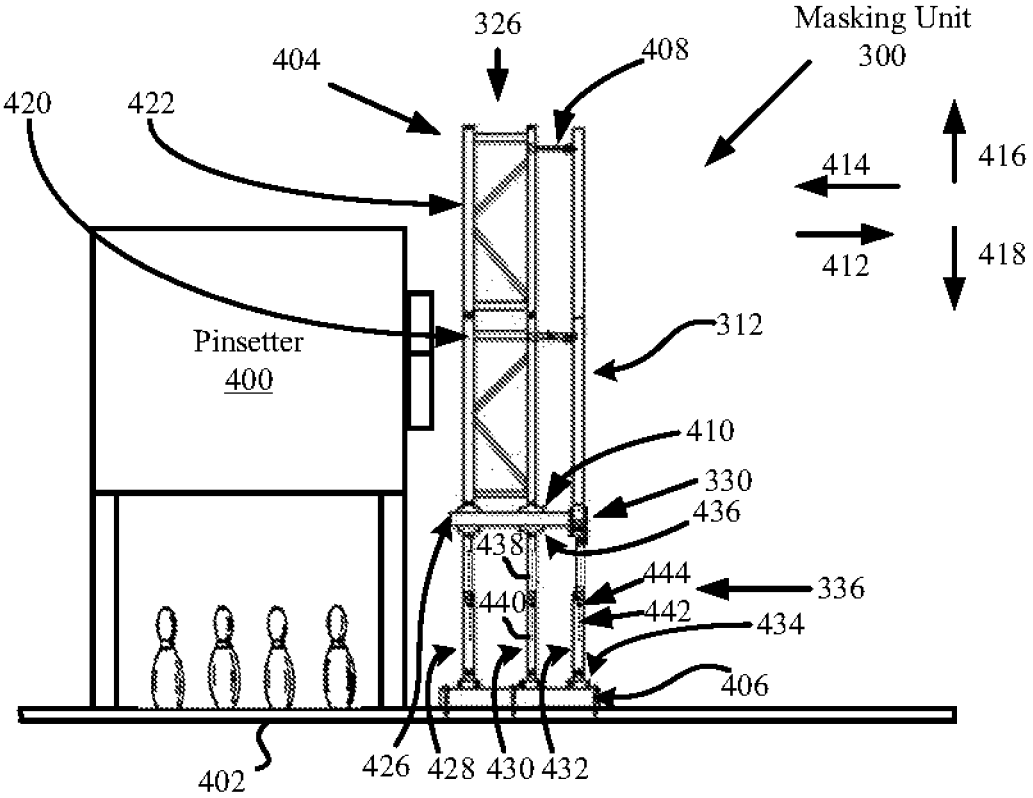
FIG. 4 is a side view of the masking unit shown in FIG. 3 masking pinsetters of a lane pair.

The pinsetters 106 of FIG. 1 are the same as or similar to pinsetter 400 of FIG. 4. The pinsetter 400 resides at a back end 310 of the bowling lanes 306, 308. Accordingly, the masking unit 300 also resides at the back end 310 of the bowling lanes 306, 308, and is securely coupled to the ground 402 via a lane mount support frame 404. The ground 402 can include, but is not limited to, a bowling lane support structure (often made of wood), a flooring, and/or a foundation. Bowling lane support structures are well known in the art, and therefore will not be described herein. The secure coupling of the masking unit 300 to the ground 402 can be achieved via a number of coupling techniques (e.g., via a plurality of threaded screws 406 as shown in FIG. 4).

Notably, the lane mount support frame 404 does not require hanging the masking unit 300 from a ceiling of a building. The weight of the masking unit 300 is too great for a ceiling joist without additional support. Thus, the lane mount support frame 404 simplifies the installation of a masking unit, and reduces the time for such installation.

The lane mount support frame 404 structurally supports an array of displays 312 in a given orientation and position as shown in FIGS. 3-4. The displays can incorporate LED technology, LCD technology, or PDP technology. The displays are designed such that they can be synchronized with computers, used with a speaker system to provide an auditory output, and/or used as a display to provide a visual output (e.g., data, graphics, text and/or images). The displays have a relatively thin depth (e.g., less than three inches). In some scenarios, the displays include, but are not limited to, a flat panel display having part number CLI 2.6 Series which are available from Planar a Leyard company of Portland, Oreg.

The displays can be tiled together to form a large multi-panel display as shown in FIG. 3. In this regard, it should be understood that the displays have coupling means integrated therewith which allow the displays to be mechanically and electrically coupled to each other and decoupled from each other. Techniques for coupling/decoupling displays are well known in the art, and therefore will not be described in detail herein.

In some scenarios (e.g., LED panel scenarios), structures are provided on the sides of the displays that can slidingly engage each other so as to couple adjacent displays to each other. Additionally, pins are provided that protrude out of a top surface of each display. The pins may be spring loaded, and/or able to be hidden inside the displays when not in use. The pins have a notch or flange at a free top end thereof. Apertures are formed in a bottom surface of the displays that are sized and shaped to receive the pins of other displays, respectively. Catch mechanisms (e.g., clamps, posts, latches, etc.) are disposed in the apertures. The catch mechanisms engage the notch or flange of the pins so as to mechanically couple the displays together. Release mechanisms are provided to disengage the catch mechanism from the pins such that the panels can be decoupled from each other. Mating electrical connectors are also provided to electrically connect adjacent displays to each other. The present solution is not limited to the particulars of this scenario.

The array 312 is shown as comprising fourteen displays arranged into two rows 314, 316 and seven columns 318. The present solution is not limited in this regard. The array can include any number of panel displays arranged in any number of rows/columns selected in accordance with a particular application. Each display is arranged such that it abuts one or two adjacent panel displays in the same row. For example, panel display 320 resides next to, is horizontally aligned with and abuts adjacent panel displays 322 and 324 of the same row 314. The present solution is not limited to the particulars of this example.

As noted above, the lane mount support frame 404 structurally supports the array of displays 312 in a given orientation and position as shown in FIGS. 3-4. In this regard, the lane mount support frame 404 comprises vertical support members 326, 328, strut bar(s) 408, elongate bar(s) 500, a horizontal support member 330, and vertical mounting legs 336, 338.

Each vertical support member 326, 328 comprises a ladder truss structure. Ladder truss structures are well known in the art, and therefore will not be described in detail herein. Any ladder truss structure architecture can be used herein without limitation. Each vertical support member 326, 328 comprises at least one coupler 410 for facilitating the securement of the vertical support member to a vertical mounting leg 336, 338, as shown in FIGS. 3-4. The coupler 410 can include, but is not limited to, a flange with through holes formed therein, a post socket with through holes formed therein, screws and/or bolts. The coupler 410 can be a separate component from the ladder truss structure, or alternatively be integrally formed with the ladder truss structure.

Figure 5:
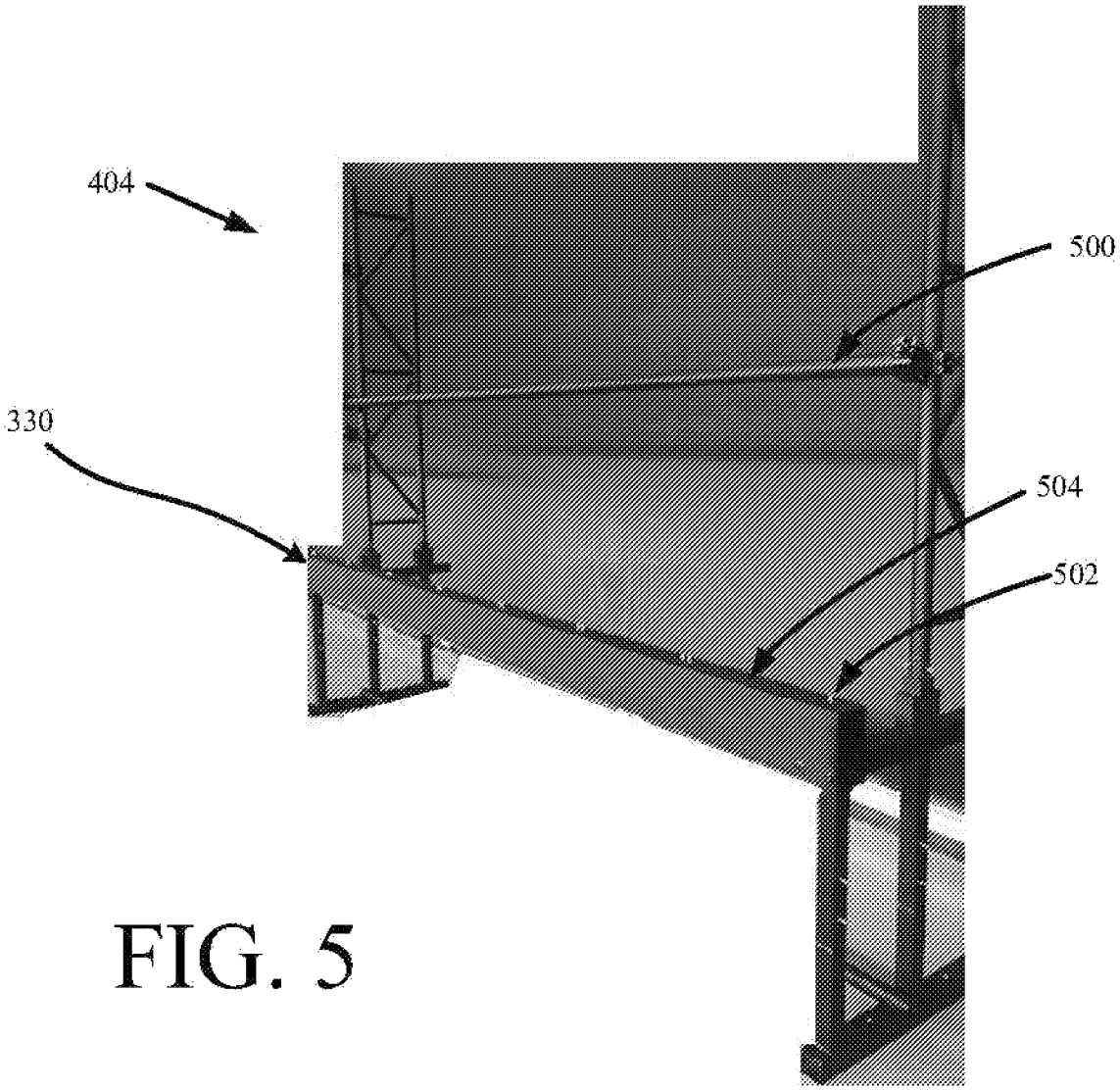
FIG. 5 is a perspective view of the masking unit shown in FIGS. 3-4 with the display array removed therefrom.
Figure 6:
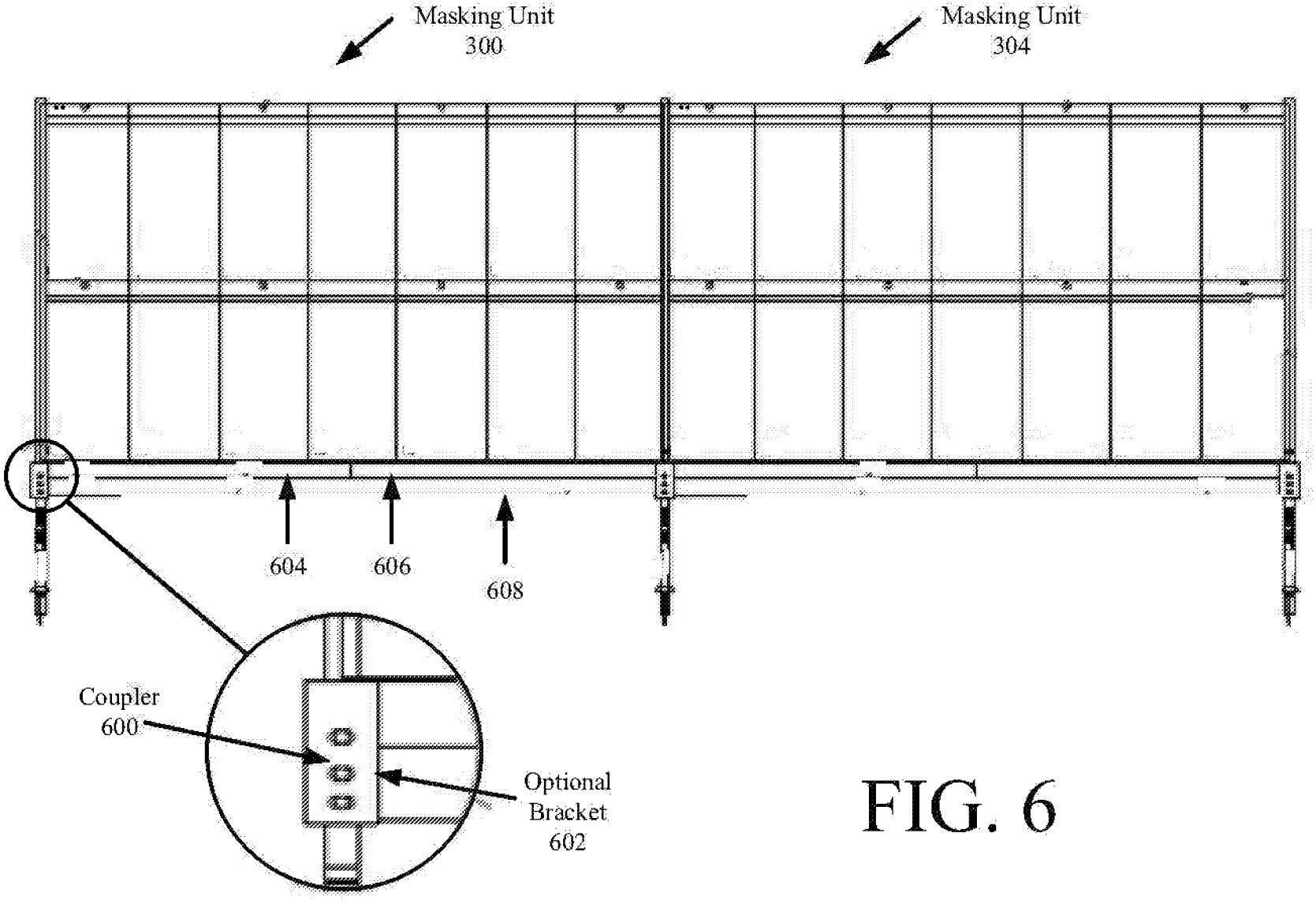
FIG. 6 is a front view of the masking unit shown in FIGS. 1, 3-5.
Figure 7:
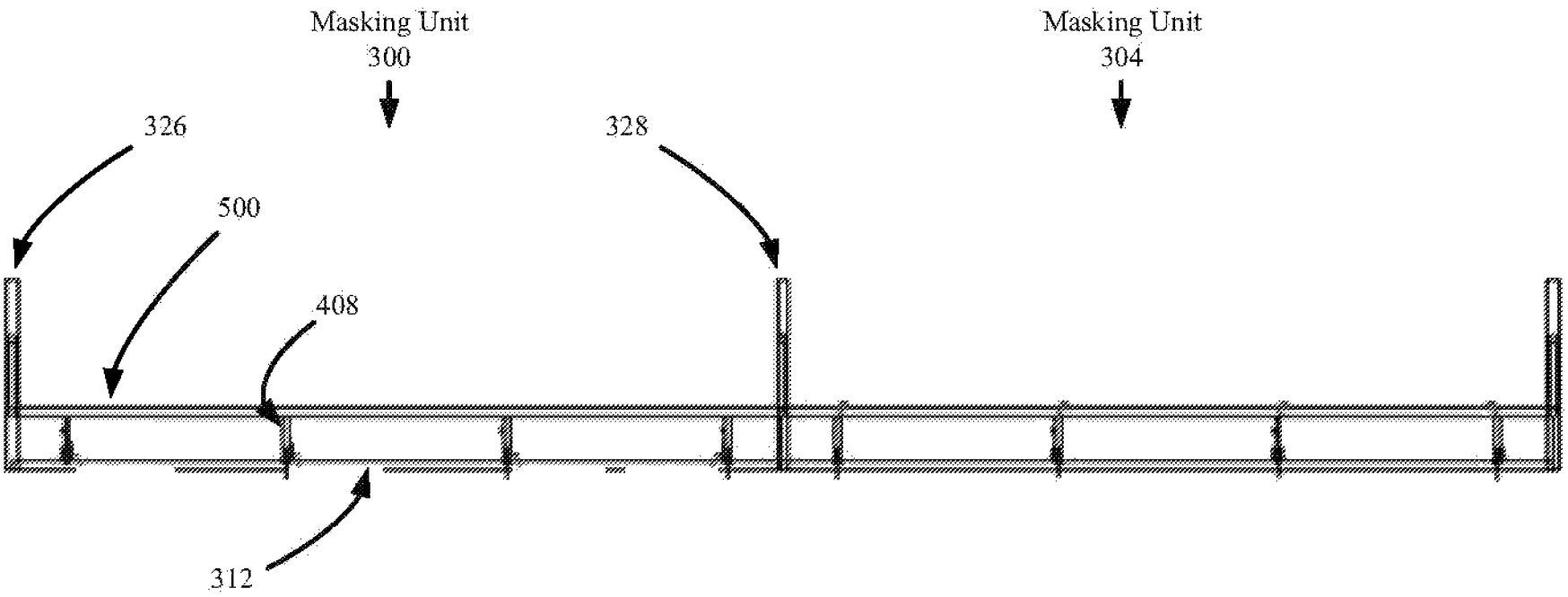
FIG. 7 is a top of the masking unit shown in FIGS. 1 and 3-6.

In some scenarios, two or more ladder truss structure sub-pieces 420, 422 are provided which can be connected to each other as shown in FIG. 4 to form a larger ladder truss structure. The ladder truss structure sub-pieces can be the same or different from each other. This configuration has certain advantages related to transportation of the masking unit. Still, the present solution is not limited in this regard. The ladder truss structure can alternatively comprise a single piece as shown in FIG. 5. In either case, the ladder truss structure can be connected to other ladder truss structures to selectively modify the overall height of the masking unit 300 in accordance with a particular application.

The strut bar(s) 408 and elongate bar(s) 500 securely couple the display array 312 to the vertical support members 326, 328. In this regard, it should be understood that one or more elongate bars 500 extend between the two ladder truss structures 326, 328, as shown in FIG. 5. The strut bars 408 connect the display array 312 to the vertical support members 326, 328 via the elongate bar(s) 500. The vertical support members 326, 328, strut bar(s) 408 and/or elongate bar(s) 500 comprise separate pieces. This configuration facilitates an ease of transportation of the masking unit 300. During assembly of the masking unit 300, the sub-pieces 326, 328, 408, 500 are coupled to each other via any suitable coupling means. The coupling means includes, but is not limited to, threaded screws, bolts, latches, hooks, and/or adhesives.

The bars 408, 500 are designed to facilitate a prevention of movement of the display array 312 in a forwards direction 412, a backwards direction 414, an upwards direction 416, and a downwards direction 418 relative to the vertical support members 326, 328. The vertical support members 326, 328, strut bar(s) 408 and/or bar(s) 500 are formed of a rigid material (such as steel or aluminum) so that the display array 312 does not bend or otherwise deform when in use. Any number of strut bars 408 and/or elongate bars 500 can be provided in accordance with a given application.

Each vertical mounting leg 336, 338 comprises a bottom plate 406, a top plate 426, and a plurality of posts 428, 430, 432 coupled between the top and bottom plates. Three posts 428, 430, 432 are shown in the figures. The present solution is not limited in this regard. Any number of posts (e.g., 1-10) can be provided in accordance with a given application.

In some scenarios, the listed components 406, 426, 428, 430, 432 comprise a single part. In other scenarios, the listed components 406, 426, 428, 430, 432 are separate sub-parts that can be coupled to and decoupled from each other. This sub-part configuration has certain advantages in relation the transportation of the masking unit 300. The posts 428, 430, 432 are coupled to the plates 406, 426 via coupling mechanisms 434, 436. The coupling mechanisms 434, 436 include, but are not limited to, post sockets with through holes and/or threaded screws or bolts.

Figure 8:
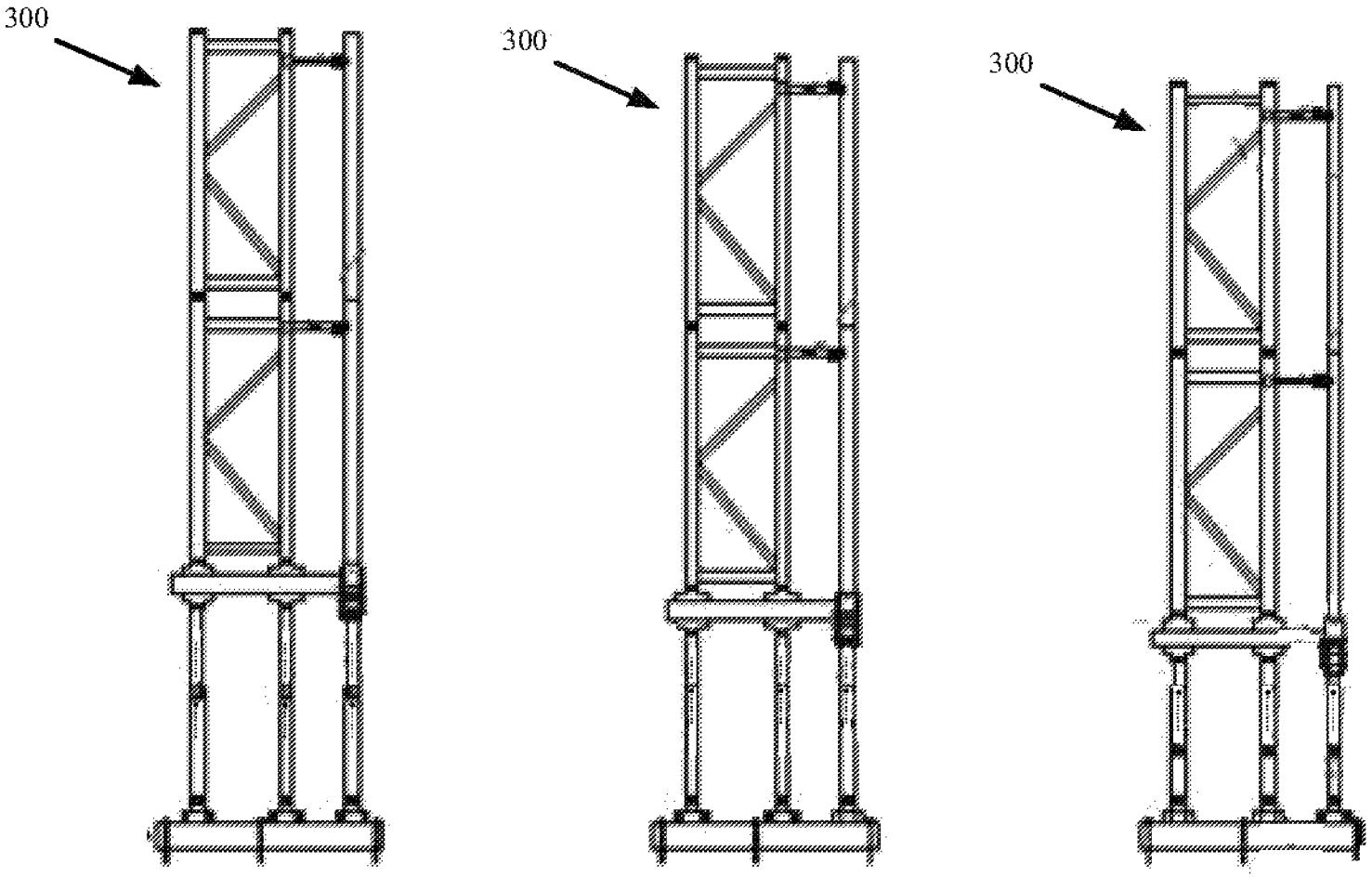
FIG. 8 provides an illustration that is useful for understanding a height adjustment feature of the masking unit shown in FIGS. 1 and 3-7.
Figure 9:
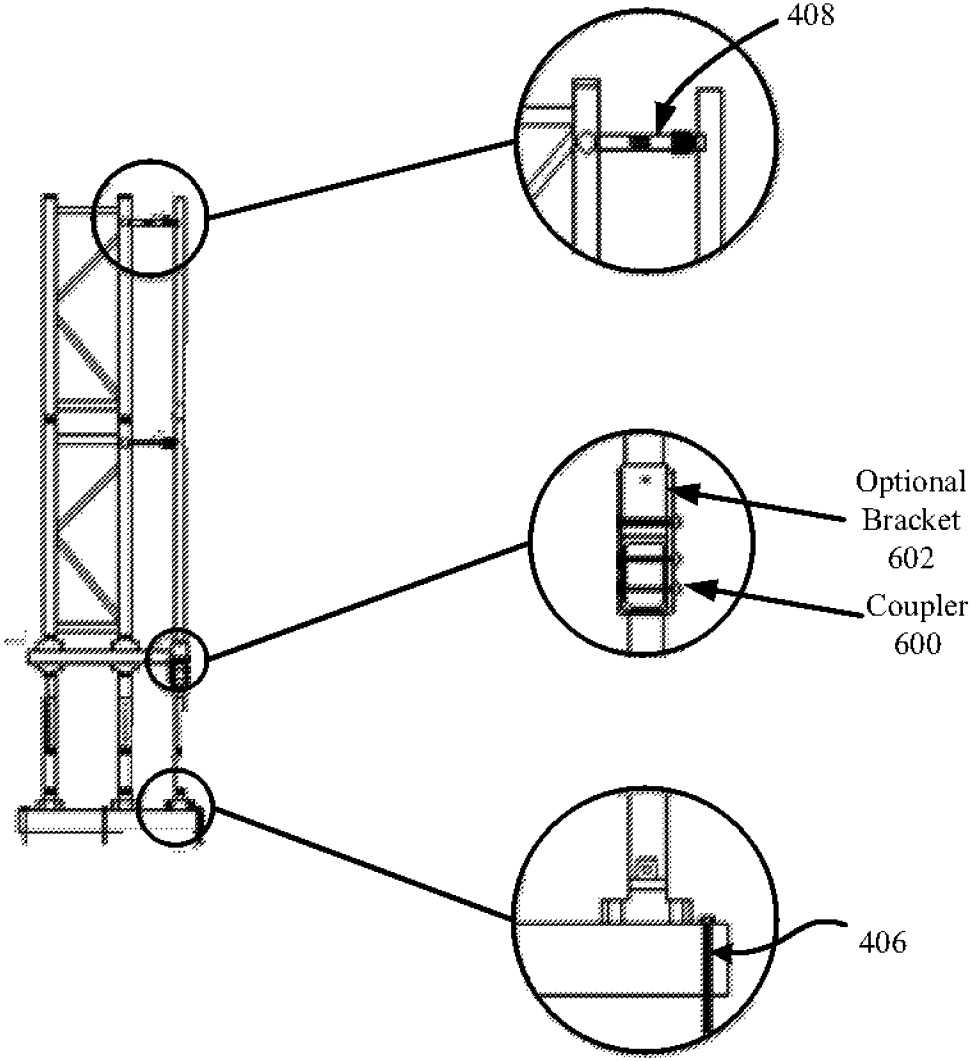
FIG. 9 provides an illustration that is useful for understanding certain components of the masking unit shown in FIGS. 1 and 3-8.

Each post 428, 430, 432 is adjustable such that the height of the masking unit 300 can be selectively varied in accordance with a given application, as shown in FIG. 8. This adjustable feature of the posts 428, 430, 432 allows the display screen portion of the masking unit 300 to be moved up and down to match the height of the pinsetter 400 or other object which is to be concealed or masked by the masking unit 300.

There are many ways to make a post height adjustable. Any known or to be known technique for providing a height adjustable post can be used herein. In some scenarios, each post 428, 430, 432 comprises at least two telescoping sub-posts 438, 440. One or more of the sub-posts has a plurality of apertures 442 formed along an elongate length thereof. A pin 444 can be removably inserted into each of the apertures 442. A given height of the masking unit 300 is maintained when the pins 444 are inserted in apertures 442 of the posts 428, 430, 432. The height of the masking unit 300 is adjusted by removing the pins from the apertures, and inserting the pins in other ones of the apertures. The present solution is not limited to the particulars of these scenarios.

The horizontal support member 330 structurally supports the display array 312 in the horizontal direction. The horizontal support member 330 is designed to facilitate the prevention of movement of the display array 312 in a downwards direction 418 relative to the vertical support members 326, 328. In this regard, the horizontal support member 330 is formed of a rigid material (such as steel and/or aluminum) so that the horizontal support member 330 does not bend or otherwise deform when the masking unit 300 is in use.

The horizontal support member 330 may comprise a single piece or a plurality of sub-pieces. In one sub-piece scenario, the horizontal support member 330 comprises three sub-pieces 604, 606, 608. Top sub-pieces 604 and 606 are formed of aluminum, while bottom sub-piece 608 is formed of steel. The present solution is not limited to the particulars of the is sub-piece scenario.

The horizontal support member 330 is securely coupled to the vertical mounting legs 336, 338 via one or more couplers 600 and/or optional brackets 602. The couplers 600 can include, but are not limited to, screws, bolts, and/or pins.

The horizontal support member 330 comprises a plurality of additional couplers 502 protruding out and away from a top surface 504 thereof. These couplers 502 mechanically couple the display array 312 to the horizontal support member 330. This mechanical coupling can be achieved in the same or similar manner as that which is employed to couple the displays to each other. The couplers 502 may also facilitate the electrical connection of the displays to an external device, such as the centralized control system 114 of FIG. 1. In this regard, one or more wires and/or cables can pass through the horizontal support member 330.

As noted above, the masking unit 300 is a modular component which can be used with other masking units 302 and/or 304. In some scenarios in which two or more masking units are used together, it may be desirable to also increase (e.g., double, triple, etc.) the height of the masking units so as to ensure that the same or similar aspect ratio of the video is provided.

In some scenarios, one or more optional ball indicator lights 340 are coupled to the support frame(s) and/or integrated with the display(s). The ball indicator lights are provided to indicate to a bowler which bowling shot(s) he is on. For example, the total number of eliminated ball indicator lights represents the current bowling shot number (e.g., ball one, ball two, etc.). The ball indicator lights are communicatively coupled to and/or controlled by a bowling scoring system.

In those or other scenarios, optional bowling lane number are provided or shown on the front of the masking unit(s). The bowling lane numbers can be a stick-on vinyl number.

In those or other scenarios, the mounting support system is also used to mount on or more bowing pin setter pindeck light fixtures and/or video projection system(s). Bowling pin setter pindeck light fixtures and video projection systems are well known in the art, and therefore will not be described herein. Any known or to be known bowling pin setter pindeck light fixture and video projection system can be used herein without limitation.

Referring now to FIG. 10, there are provided illustration of another illustrative masking unit 1000. A top view of the masking unit 1000 is provided in FIG. 10A. A side view of the masking unit 1000 is provided in FIG. 10B. A front view of the masking unit 1000 is provide in FIG. 10C. FIGS. 10A-10C do not show the panel wall mounting couplers and how the mounting couplers would attach the panel to the wall for simplicity of illustrations. Wall mounting couplers are well known in the art, and therefore are not described in detail herein. Any known or to be known wall mount couplers can be used herein in accordance with a given application.

The masking unit 1000 includes two displays 1050, 1052 coupled to each other. Each display 1050, 1052 comprises a plurality of LCD or PDP display panels 1002. These panels 1002 mount to the frame structure 1004 similar to the way the LED panels are mounted to the frame structure. The first row of LCD or PDP display panels 1002 rest their bottom surfaces on the main frame 1004 and in front of mounting pins. Each of the LCD or PDP display panels 1002 includes a wall mount with two half coupler clamps (not shown) on the wall mounting side thereof. A horizontal mounting pipe 1006 extends between vertical supports 1008, 1114. Two short pipes 1010, 1012 are secured to the horizontal mounting pipe 1006 by two half couplers.

After the first row of displays are securely mounted to the main frame 1004, a second row of LCD or PDP displays are added. The bottom bezel of the displays in the second row rest on top bezels of the displays in the first row. The displays of the second row also include LCD or PDP displays with wall mount couplers. A second horizontal mounting pipe 1016 extends from the vertical supports 1008, 1114. Two short pipes 1018, 1020 are secured to the second horizontal mounting pipe 1016 via two half couplers. Additional rows of displays could be added if necessary if smaller displays are used.

Power and data connections can be made to each of the displays similar to how the LED panels are connected. Each display could be used as an individual display or could be grouped to be used with one image across multiple displays. The LCD or PDP displays could be mounted in landscape of portrait orientations.

Although the present solution has been illustrated and described with respect to one or more implementations, equivalent alterations and modifications will occur to others skilled in the art upon the reading and understanding of this specification and the annexed drawings. In addition, while a particular feature of the present solution may have been disclosed with respect to only one of several implementations, such feature may be combined with one or more other features of the other implementations as may be desired and advantageous for any given or particular application. Thus, the breadth and scope of the present solution should not be limited by any of the above described embodiments. Rather, the scope of the present solution should be defined in accordance with the following claims and their equivalents.

What is claimed is:

1. A system for masking pinsetters of a bowling center, comprising:

a first modular masking unit comprising a first array of displays structurally supported by a first support frame mounted to a ground, the first array of displays masking pinsetters for a first pair of bowling lanes; and a second modular masking unit connected to the first modular masking unit and comprising a second array of displays structurally supported by a second support frame mounted to the ground, the second array of displays masking pinsetters for a second pair of bowling lanes adjacent to the first pair of bowling lanes;

wherein each of the first and second support frames comprise:

a right side vertical support member configured to facilitate vertical support of the first or second array of displays;

a left side vertical support member configured to facilitate vertical support of the first or second array of displays;

a right side vertical mounting leg coupled to the right side vertical support member and the ground, and comprising a right-side vertically telescoping sub-post configured to facilitate a height adjustment of the right side vertical support member;

a left side vertical mounting leg coupled to the left side vertical support member and the ground, and comprising a left-side vertically telescoping sub-post configured to facilitate a height adjustment of the left side vertical support member;

a horizontal support member that extends between the right side vertical mounting leg and the left side vertical mounting leg and configured to support at least one display of the first or second array of displays from directly beneath, wherein the horizontal support member comprises a plurality of additional couplers protruding out and away from a top surface thereof and configured to mechanically couple at least one display of the first or second array of displays to the horizontal support member;

at least one elongate bar extending between the right side vertical support member and the left side vertical support member; and at least one rigid strut bar extending forward from the at least one elongate bar and coupled between the at least one elongate bar and the rear of the first or second array of displays;

wherein the first and second modular masking units are configured for selective use as two media display systems independent of each other at a first time and for selective use collectively as a single media display system at a second different time; and wherein the first support frame and the second support frame each comprise at least one sub-post configured to telescope in a substantially vertical direction to permit height adjustments between the respective first or second array of displays and the ground.

2. The system according to claim 1, wherein the first and second modular masking units are at least one of mechanically connectable to each other and electrically connectable to each other.

3. The system according to claim 1, wherein the displays of the first and second arrays comprise at least one of a Light Emitting Diode ("LED") panel, a Liquid Crystal Display ("LCD") panel, and a Plasma Display Panel ("PDP") based display.

4. The system according to claim 1, wherein adjacent displays of the first and second modular masking units abut when the first modular masking unit and the second modular masking unit are coupled to each other.

5. The system according to claim 1, wherein the ground comprises a bowling lane support structure.

6. The system according to claim 1, further comprising a control system configured to independently control the displays of the first or second array to provide a plurality of small displays or collectively control the displays of the first or second array to provide a single large multi-panel display.

7. The system according to claim 1, wherein each of the right side vertical support member and the left side vertical support member comprises a ladder truss structure.

8. The system according to claim 1, wherein each of the right side vertical support member and the left side vertical support member comprises at least two ladder truss structure sub-pieces that are joined together to form a large ladder truss structure.

9. A system for masking pinsetters of a bowling center, comprising:

a first modular masking unit comprising a first array of displays structurally supported by a first support frame, the first support frame mounted to a ground so that the first array of displays extends over a first pair of bowling lanes and masks the pinsetters for the first pair of bowling lanes;

wherein each of the first and second support frames comprise:

a right side vertical support member configured to facilitate vertical support of the first or second array of displays;

a left side vertical support member configured to facilitate vertical support of the first or second array of displays;

a right side vertical mounting leg coupled to the right side vertical support member and the ground, and comprising a right-side vertically telescoping sub-post configured to facilitate a height adjustment of the right side vertical support member;

a left side vertical mounting leg coupled to the left side vertical support member and the ground, and comprising a left-side vertically telescoping sub-post configured to facilitate a height adjustment of the left side vertical support member;

a horizontal support member that extends between the right side vertical mounting leg and the left side vertical mounting leg and configured to support at least one display of the first or second array of displays from directly beneath, wherein the horizontal support member comprises a plurality of additional couplers protruding out and away from a top surface thereof and configured to mechanically couple at least one display of the first or second array of displays to the horizontal support member;

at least one elongate bar extending between the right side vertical support member and the left side vertical support member; and at least one rigid strut bar extending forward from the at least one elongate bar and coupled between the at least one elongate bar and the rear of the first or second array of displays; and wherein the first support frame comprises at least one sub-post configured to telescope in a substantially vertical direction to permit adjustments of a distance between the first array of displays and the ground.

10. The system according to claim 9, wherein the displays of the first array comprise at least one of a Light Emitting Diode ("LED") panel, a Liquid Crystal Display ("LCD") panel, and a Plasma Display Panel ("PDP") based display.

11. The system according to claim 9, wherein the ground comprises a bowling lane support structure.

12. The system according to claim 9, wherein each of the right side vertical support member and the left side vertical support member comprises a ladder truss structure.

13. The system according to claim 9, wherein each of the right side vertical support member and the left side vertical support member comprises at least two ladder truss structure sub-pieces that are joined together to form a large ladder truss structure.

14. The system according to claim 9, further comprising a second modular masking unit coupled to the first modular masking unit and comprising a second array of displays structurally supported by a second support frame, the second support frame mounted to the ground so that the second array of displays extends over a second pair of bowling lanes and masks pinsetters for the second pair of bowling lanes.

15. The system according to claim 14, further comprising a control system configured to independently control the displays of the first or second array to provide a plurality of small displays or collectively control the displays of the first or second array to provide a single large multi-panel display.

16. The system according to claim 14, wherein adjacent displays of the first and second modular masking units abut when the first modular masking unit and the second modular masking unit are coupled to each other.

17. The system according to claim 9, wherein the first support frame is used to mount at least one of a bowling pinsetter pindeck light fixture and a video projection system.

18. The system for masking pinsetters of a bowling center of claim 1, wherein the at least one sub-post comprises at least two vertically telescoping sub-posts.

19. The system for masking pinsetters of a bowling center of claim 9, wherein the at least one sub-post comprises at least two vertically telescoping sub-posts.

20. The system for masking pinsetters of a bowling center of claim 1, wherein the at least one sub-post comprises a plurality of apertures along an elongate length thereof, wherein each aperture is configured to removably receive a pin, such that the at least one sub-post maintains a first height between the respective first or second array of displays and the ground when the pin is inserted into a first aperture and the at least one sub-post maintains a second height when the pin is inserted into a second aperture, the second aperture different than the first aperture and the second height different than the first height.

21. The system for masking pinsetters of a bowling center of claim 9, wherein the at least one sub-post comprises a plurality of apertures along an elongate length thereof, wherein each aperture is configured to removably receive a pin, such that the at least one sub-post maintains a first height between the first array of displays and the ground when the pin is inserted into a first aperture and the at least one sub-post maintains a second height when the pin is inserted into a second aperture, the second aperture different than the first aperture and the second height different than the first height.

22. The system for masking pinsetters of a bowling center of claim 1, wherein the plurality of additional couplers further comprise electrical connectors configured to connect to the first array of displays.

23. The system for masking pinsetters of a bowling center of claim 9, wherein the plurality of additional couplers further comprise electrical connectors configured to connect to the first array of displays.

* * * * *